US008355519B2

(12) United States Patent
Gommel et al.

(10) Patent No.: US 8,355,519 B2
(45) Date of Patent: Jan. 15, 2013

(54) TOOL FOR FITTING AND REMOVING A RECEIVER OF A HEARING AID

(75) Inventors: Uli Gommel, Erlangen (DE); Marco Lederer, Hirschaid/Erlach (DE); Ottmar Ruschig, Forchheim (DE); Friedrich Zenk, Hemhofen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 151 days.

(21) Appl. No.: 13/018,762

(22) Filed: Feb. 1, 2011

(65) Prior Publication Data

US 2011/0188691 A1 Aug. 4, 2011

(30) Foreign Application Priority Data

Feb. 1, 2010 (DE) ..... 10 2010 006 454

(51) Int. Cl.
*H04R 25/00* (2006.01)

(52) U.S. Cl. ..... 381/329; 381/325

(58) Field of Classification Search ..... 381/322–325, 381/328–329

See application file for complete search history.

(56) References Cited

U.S. PATENT DOCUMENTS

| | | | | |
|---|---|---|---|---|
| 2,266,874 | A * | 12/1941 | Larson | 29/278 |
| 7,443,993 | B2 * | 10/2008 | Gunnersen et al. | 381/329 |
| 8,019,106 | B2 * | 9/2011 | Gunnersen et al. | 381/325 |
| 2003/0002700 | A1 | 1/2003 | Fretz et al. | |
| 2005/0018867 | A1 | 1/2005 | Gunnersen et al. | |
| 2009/0046880 | A1 | 2/2009 | Gunnersen et al. | |
| 2009/0082801 | A1 | 3/2009 | Giese et al. | |
| 2009/0285428 | A1 | 11/2009 | Gilgert | |

FOREIGN PATENT DOCUMENTS

| | | | |
|---|---|---|---|
| DE | 2248080 | A1 | 4/1974 |
| DE | 29608352 | U1 | 10/1996 |
| DE | 29924999 | U1 | 2/2008 |
| EP | 1562400 | A2 | 8/2005 |
| EP | 2040488 | A2 | 3/2009 |
| GB | 403769 | A | 1/1934 |
| WO | 0003561 | A1 | 1/2000 |

OTHER PUBLICATIONS

Tool REC2G Mold Dissembly D10425283 (Jul. 2009).

* cited by examiner

*Primary Examiner* — Suhan Ni
(74) *Attorney, Agent, or Firm* — Laurence A. Greenberg; Werner H. Stemer; Ralph E. Locher

(57) ABSTRACT

A tool is provided with which a receiver of a hearing aid can be easily fitted into an earpiece or an ear mold and removed therefrom. The tool has an elongate main body, a first tool part for removing the receiver from a first earpiece, a second tool part for removing the receiver from a second earpiece, and a third tool part for fitting the receiver into the first or second earpiece. The elongate main body is divided into a first subsidiary body and a second subsidiary body). The two subsidiary bodies can be plugged at least partially one inside the other in the direction of the longitudinal axis of the main body. In addition, two of the three tool parts are arranged on one of the two subsidiary bodies, and the remaining tool part is arranged on the other of the two subsidiary bodies.

10 Claims, 3 Drawing Sheets

TOOL FOR FITTING AND REMOVING A RECEIVER OF A HEARING AID

CROSS-REFERENCE TO RELATED APPLICATION

This application claims the priority, under 35 U.S.C. §119, of German application DE 10 2010 006 454.8, filed Feb. 1, 2010; the prior application is herewith incorporated by reference in its entirety.

BACKGROUND OF THE INVENTION

Field of the Invention

The invention relates to a tool for fitting a receiver of a hearing aid into a first earpiece and into a structurally different, second earpiece and for removing the receiver from the first or second earpiece. The tool has an elongate main body, a first tool part for removing the receiver from the first earpiece, a second tool part for removing the receiver from the second earpiece, and a third tool part for fitting the receiver in the first or second earpiece.

Hearing aids are portable hearing devices used to support the hard of hearing. In order to meet the numerous individual requirements, different types of hearing aids are made available, e.g. behind-the-ear (BTE) hearing aids, hearing aids with an external receiver (receiver in the canal (RIC)) and in-the-ear (ITE) hearing aids, for example concha hearing aids or canal hearing aids (ITE, CIC). The hearing aids listed by way of example are worn on the concha or in the auditory canal. Furthermore, however, bone conduction hearing aids, implantable or vibrotactile hearing aids are also available on the market. In these, the damaged sense of hearing is stimulated either mechanically or electrically.

In principle, the main components of hearing aids are an input transducer, an amplifier and an output transducer. In general, the input transducer is a sound receiver, e.g. a microphone, and/or an electromagnetic receiver, e.g. an induction coil. The output transducer is usually configured as an electroacoustic transducer, e.g. a miniaturized loudspeaker, or as an electro-mechanical transducer, e.g. a bone conduction receiver. The amplifier is usually integrated into a signal-processing unit. This basic configuration is illustrated in FIG. 1 using the example of a behind-the-ear hearing aid. One or more microphones 2 for receiving the sound from the surroundings are installed in a hearing aid housing 1 to be worn behind the ear. A signal-processing unit 3, likewise integrated into the hearing aid housing 1, processes the microphone signals and amplifies them. The output signal of the signal-processing unit 3 is transferred to a loudspeaker or receiver 4, which emits an acoustic signal. If necessary, the sound is transferred to the eardrum of the equipment wearer via an acoustic tube, which is fixed to an ear mold in the auditory canal. A battery 5, likewise integrated into the hearing aid housing 1, supplies the hearing aid and in particular the signal-processing unit 3 with energy.

In hearing aids with an external receiver, called RIC hearing aids, the receivers are each mounted in an earpiece. The purpose of the earpieces is to hold the receiver in the auditory canal and, if appropriate, to seal the auditory canal. The earpieces can be individually prepared ear molds that are adapted to the shape of the auditory canal of the individual wearing the hearing aid. Alternatively, it is also possible to use earpieces that can be applied generally, i.e. that are not individually adapted and therefore cost less. The individually prepared ear molds are either filled ear molds or what are called film ear molds, which are not filled or not completely filled on the inside.

When fitting a receiver into an earpiece, there is a danger of the receiver not being fixed exactly in the earpiece. In addition, there is a danger of the receiver being damaged during fitting.

Typically, an external receiver is fitted by clicking it into a special earpiece adapter, which in turn is mounted in the earpiece or the ear mold or is part of the earpiece. The receiver is removed by being pressed out of the adapter from the other side with the aid of a pin. As has been mentioned, the earpiece can be an individually adapted earpiece (ear mold) or an earpiece that can be applied generally. For the sake of simplicity, only one of these terms will mostly be used hereinbelow as representing all earpieces.

To fit an external receiver into an earpiece adapter or remove the receiver therefrom, a tool has hitherto been used which has an elongate shape and which has axially protruding pin-shaped extensions on both end faces. These two extensions are of different lengths and flexible. Their diameter is exactly the same size as the acoustic output channel from the earpiece. The pin-like extensions are used to press a receiver out of the adapter of an earpiece from the side of the earpiece directed toward the eardrum. Depending on the type of earpiece (e.g. filled ear mold or film ear mold), a longer or shorter pin is needed to press the receiver out. Since the pin-shaped extensions of the tool have to be flexible, the reason being that the acoustic channels in the earpieces are not always rectilinear, the tip of the tool, i.e. the pin-shaped extension, must be as short as possible in order to ensure that it can exert a predefined pressure on the receiver without kinking. The tool therefore has a short pin-shaped extension for film ear molds and a longer pin-shaped extension for filled ear molds, which have a longer acoustic channel.

Moreover, a groove is provided on the elongate tool and extends transversely with respect to the longitudinal direction of the tool, and the cable attachment at the bottom of the receiver can be pressed into the groove. Since the receiver has a greater diameter than the cable, force from the tool can be exerted, transversely with respect to the longitudinal direction of the tool, onto the receiver in order to fit same into an earpiece when the cable attachment at the bottom of the receiver is pressed into the groove of the tool.

The design of the tool causes a number of problems when fitting the receiver in the respective earpiece and removing the receiver therefrom. First, the external receiver is not guided and does not have a sufficient hold when being fitted into the respective earpiece or ear mold. It is sometimes quite impossible to fit the receiver into an earpiece using the tool, since the tool, during the fitting procedure, abuts against the top edge of the earpiece or ear mold, i.e. the edge facing outward from the auditory canal when the earpiece is being worn. Moreover, there is no protection against kinking between the tube or cable and the external receiver during fitting. In addition, the overall handling of the tool is poor from the ergonomic point of view, since the fitting pressure must take place under 90° (tilting movement).

SUMMARY OF THE INVENTION

It is accordingly an object of the invention to provide a tool for fitting and removing a receiver of a hearing aid which overcomes the above-mentioned disadvantages of the prior art devices of this general type, in which the external receiver of a hearing aid can more reliably be fitted into an earpiece and removed therefrom via the tool.

According to the invention, the object is achieved by a tool for fitting a receiver of a hearing aid into a first earpiece and into a structurally different, second earpiece and for removing the receiver from the first or second earpiece. The tool has an elongate main body, a first tool part for removing the receiver from the first earpiece, a second tool part for removing the receiver from the second earpiece, and a third tool part for fitting the receiver into the first or second earpiece. The elongate main body is divided into a first subsidiary body and a second subsidiary body, the two subsidiary bodies can be plugged at least partially one inside the other in the direction of the longitudinal axis of the main body. Two of the three tool parts are arranged on one of the two subsidiary bodies, and the remaining tool part is arranged on the other of the two subsidiary bodies.

The tool advantageously combines three tool parts, which are arranged on two subsidiary bodies that can be plugged one inside the other. In this way, a hearing aid wearer or an acoustician only has to handle a single tool providing him or her with three tool functions.

The tool is advantageously made of a flexible plastic. This has the advantage that the tool can be produced as an injection-molded part. In addition, it has the advantage that the tool, by virtue of its flexibility, can adapt to a non-rectilinear sound conduction section in the earpiece.

The two subsidiary bodies of the tool can each have an elongate shape. In this way, the tool as a whole has approximately a structure like a pencil, which can be easily guided by hand.

It is also of advantage if the first subsidiary body has, on one of its end faces, an opening into which the second subsidiary body can be plugged both with one of its end faces leading in the plugging direction, and also with its other end face leading in the plugging direction, into the opening of the first subsidiary body. In this way, each of the tool parts can be placed at the tip of the tool.

It can also be of advantage if the second subsidiary body has, on one end face thereof, the first tool part and, on the other end face thereof, the third tool part. Alternatively, however, the second subsidiary body can also be equipped with the first and second tool parts. This has the advantage that the tool part not required for removing the receiver from a defined earpiece can be plugged permanently into the first subsidiary body, such that the tool does not have to be inverted either for fitting or for removing the receiver.

In another embodiment, the first and second tool parts can each be configured as a pin formed integrally on one end face of one of the two subsidiary bodies. This reduces the production costs, particularly if each of the two subsidiary bodies is configured in one piece.

The two pins can be of different lengths and also slimmer than both subsidiary bodies. In this way, it is possible to take account of different lengths of acoustic passages in the earpieces. If the subsidiary bodies are not as slim as the pins, they can be handled more easily.

In another preferred embodiment, the third tool part has a shaft whose longitudinal axis extends coaxially with respect to the longitudinal axis of the respective subsidiary body, wherein the shaft is open on the end face of the subsidiary body and has a slit through which a cable of the receiver is guided out from the shaft. During fitting, the receiver can be inserted into the open end face of the subsidiary body, and the shaft protects the cable of the receiver from kinking.

It is also particularly advantageous if the receiver is plugged into the opening of the shaft and is held there by the shaft with frictional engagement. In this way, the receiver cannot slip out of the tip of the tool.

In addition, it is of advantage if the shaft has, under the opening, a shoulder on which the receiver is supported. In this way, during the fitting of the receiver, the force can be transferred from the tool to the receiver rectilinearly.

Other features which are considered as characteristic for the invention are set forth in the appended claims.

Although the invention is illustrated and described herein as embodied in a tool for fitting and removing a receiver of a hearing aid, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

The embodiments described in more detail below represent preferred embodiments of the present invention.

Figure 1:
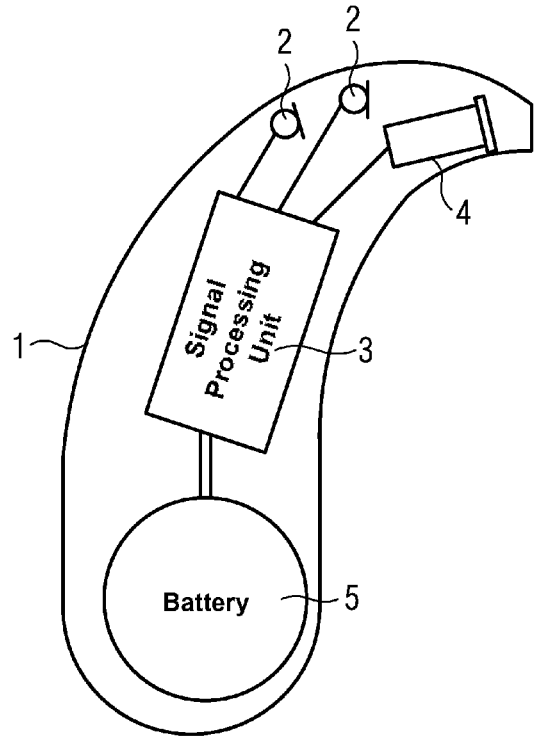
FIG. 1 PRIOR ART
FIG. 1 is a schematic view of a hearing aid as per the prior art.
Figure 2:
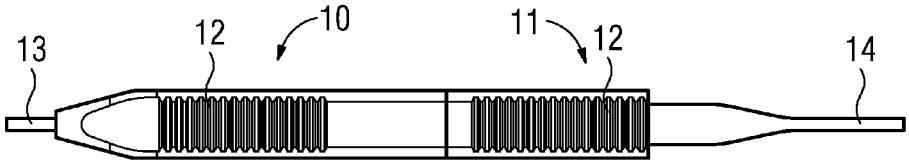
FIG. 2 is a diagrammatic, plan view of a tool according to the invention in a state when plugged together.

Referring now to the figures of the drawing in detail and first, particularly, to FIG. 2 thereof, there is shown a tool that is principally composed of a first subsidiary body 10 and a second subsidiary body 11. Both subsidiary bodies 10, 11 are plugged one inside the other and thus result in an elongate main body, which is approximately the size of a small pencil.

The two subsidiary bodies 10, 11 are preferably injected from the same plastic. They have approximately the same cross section and, on the surface, have grooves 12 extending transversely with respect to the longitudinal direction of the main body, such that increased friction can be obtained between the fingers and the tool. On one end face of the first subsidiary body 10 there is a short pin 13, which is oriented coaxially with respect to the longitudinal axis of the tool or of the main body. The short pin 13 thus protrudes from the end face of the first subsidiary body 10 as a first tool part. The short pin 13 serves to eject a receiver from an ear mold or earpiece with a short acoustic passage. It is guided into the acoustic output of the ear mold and its front end meets a receiver mounted in the ear mold or the adapter thereof. The receiver is snapped into the adapter. By pressure on the receiver with the aid of the pin 13, the snap connection is released and the receiver is pressed out of the ear mold.

At its other end face, the first subsidiary body 10 of the tool is plugged together with the second subsidiary body 11. A long pin 14 is arranged on a free end face of the second subsidiary body 11. The second subsidiary body 11 extends conically toward the much slimmer pin 14, in the same way as the first subsidiary body 10 also tapers conically toward the short pin 13. The long pin 14 forms a second tool part for removing the receiver from an ear mold or an earpiece with a longer acoustic passage.

Figure 3:
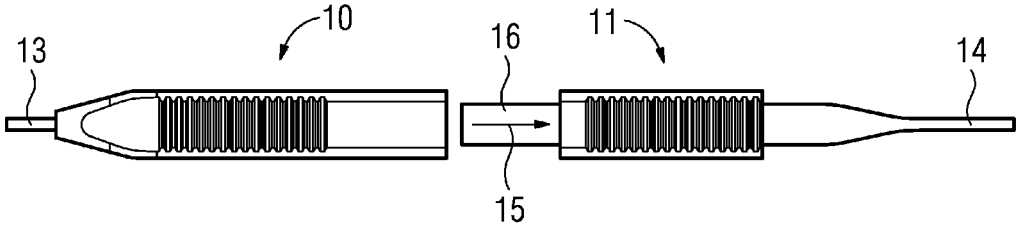
FIG. 3 is a diagrammatic, plan view of the tool from FIG. 2 in the state when unplugged.

In FIG. 3, the second subsidiary body 11 is unplugged from the first subsidiary body 10. For this purpose, the second subsidiary body 11 is pulled out of the first subsidiary body 10 according to arrow 15, which runs parallel to the longitudinal axis of the tool. It will be seen that the second subsidiary body 11 has, coaxially with respect to its longitudinal direction, an engagement portion 16 serving as a plug. The engagement portion 16 has a slightly smaller diameter and circumference than the external diameter and outer circumference of the first subsidiary body 10. A bushing, which cannot be seen in FIG. 3, is provided in the first subsidiary body 10. The engagement portion 16 of the second subsidiary body 11 is received completely in this bushing when the two subsidiary bodies 10 and 11 are plugged together according to FIG. 2.

When the two subsidiary bodies 10, 11 are in the state when plugged together, there is a frictional and/or form-fit connection, preferably a releasable snap-fit connection, between the bushing and the engagement portion 16. To separate the two subsidiary bodies 10 and 11, the force of the snap-fit connection therefore has to be overcome.

Figure 4:
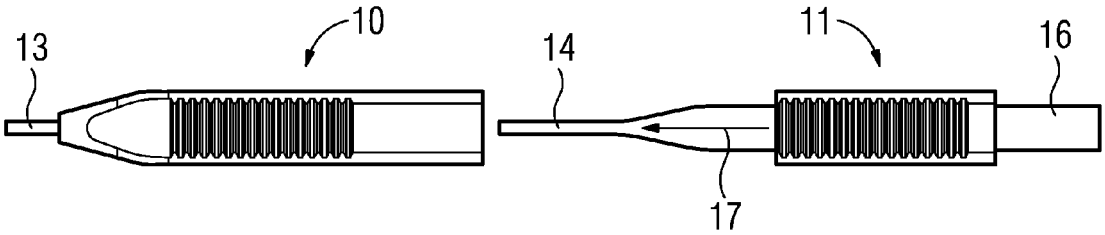
FIG. 4 is a diagrammatic, plan view of the tool from FIG. 3 with a subsidiary body turned the other way round.

FIG. 4 shows the second subsidiary body 11 turned through 180°. In other words, the long pin 14 now no longer points away from the first subsidiary body 10 but instead points directly toward the latter. Accordingly, the engagement portion 16 of the second subsidiary body 11 now points away from the first subsidiary body 10. The second subsidiary body 11 is now to be plugged according to arrow 17 into the front end bushing of the first subsidiary body 10.

Figure 5:
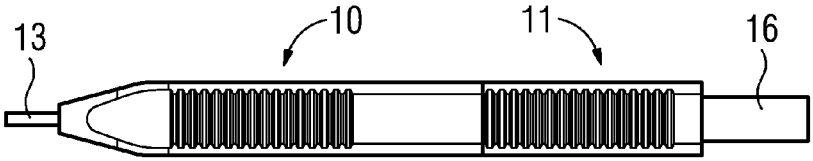
FIG. 5 is a diagrammatic, plan view of the tool plugged together in the position of FIG. 4.

FIG. 5 shows the tool in the state when plugged together anew. The tip of the second subsidiary body 11 including the long pin 14 is now plugged completely into the bushing of the first subsidiary body 10. Here too, the plugged connection is achieved by a frictional and/or form fit. By virtue of the elasticity of the plastic material, a snap-fit connection can easily be obtained once again.

At the free end of the second subsidiary body 11, the engagement portion 16 now protrudes axially outward as a third tool part for fitting a receiver into an earpiece. By contrast, the short pin 13 on the first subsidiary body 10 protrudes axially outward as a first tool part. In this plugged position, the tool can therefore be used for fitting a receiver into an earpiece or ear mold and for removing same from an ear mold with a short acoustic passage.

Figure 6:
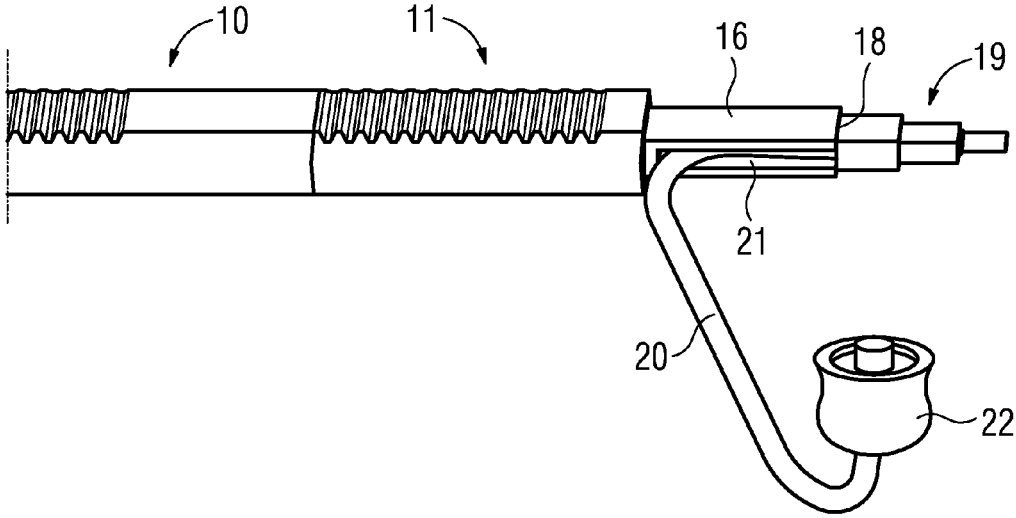
FIG. 6 is a diagrammatic, perspective view of the tool from FIG. 5 with an inserted receiver.

FIG. 6 shows the tool from FIG. 5 in a view from a slightly different direction. In particular, FIG. 6 shows the second subsidiary body 11 with the engagement portion 16 that serves as a tool part for fitting. The engagement portion 16 has, at its free end, a receiver socket 18, into which a receiver 19 is plugged. The receiver 19, which is elongate in the present example, sits in the socket 18 and has its longitudinal direction coaxial to the longitudinal direction of the tool or the longitudinal direction of the second subsidiary body 11.

The socket 18 is slightly smaller than the accommodated part of the receiver 19, such that the receiver 19 sits with frictional engagement in the socket 18. Moreover, the socket 18 has a shoulder, such that the receiver 19 cannot be pushed deeper into the socket 18. Moreover, the shoulder supporting the receiver 19 over the entire front face thereof ensures that an axial force from the tool can be transferred in a uniformly distributed manner onto the end face of the receiver 19. This provides a high degree of stability when the receiver 19 is pressed into the earpiece or an ear mold.

As can likewise be seen from FIG. 6, a cable 20 with insulating sheath is connected to the receiver 19. The cable leads into that end face of the receiver 19 that plugs into the socket 18. Therefore, the engagement portion 16, i.e. the third tool part, is provided with a groove 21 in which the cable 20 is guided outward from the receiver 19. The groove 21 serves both to stabilize the receiver 19 and also to protect against kinking of the cable 20 on the receiver 19.

At the end of the cable 20 remote from the receiver 19, there is an adapter 22 for connection to a behind-the-ear hearing aid.

The socket 18 of the third tool part can also be configured such that it can accommodate a tube adapter, which has to be plugged into an earpiece or an ear mold. Instead of the cable 20, an acoustic tube would then run in the groove 21 of the tool. Such a tube with tube adapter would be part of a behind-the-ear hearing aid with integrated receiver whose sound is guided to the earpiece via the acoustic tube.

Figure 7:
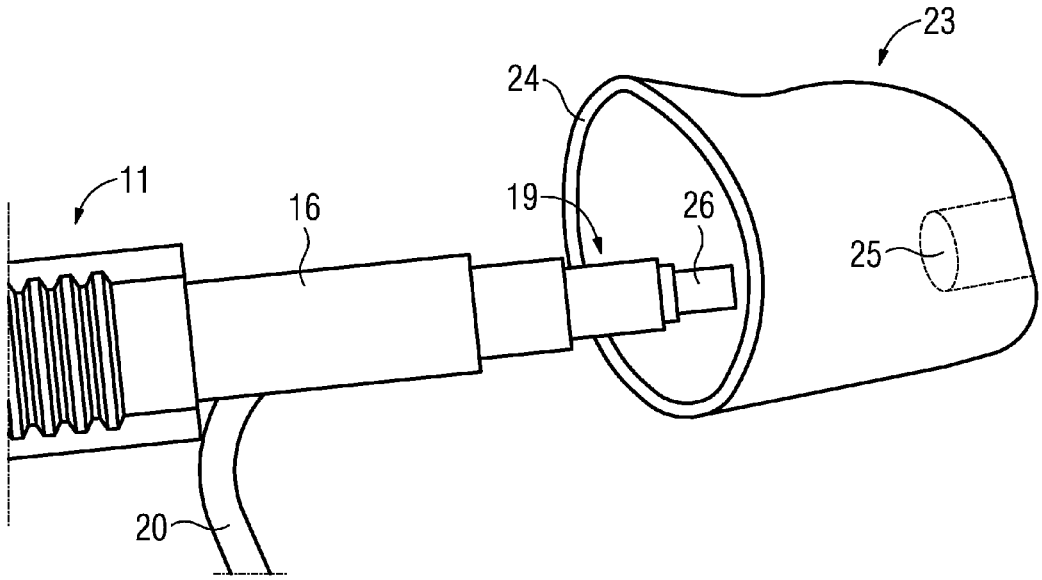
FIG. 7 is a diagrammatic, perspective view of the receiver inserted into an earpiece with the too.

FIG. 7 shows an enlarged view of that portion of the second subsidiary body 11 into which the receiver 19 with cable 20 is plugged. FIG. 7 also shows an ear mold 23 whose side facing outward during use is concave (unfilled ear mold), as a result of which a corresponding peripheral outer or upper edge 24 is formed on this ear mold. The ear mold 23 here is shaped individually from a transparent material. An adapter 25 can thus be seen on that side of the ear mold 23 directed toward the eardrum during use. The receiver 19 is plugged into the adapter 25. This is preferably done by a snap-fit connection, and the receiver 19 and the adapter 25 have corresponding undercuts. Since the receiver 19 is mostly of metal, the adapter 25 is generally produced from a somewhat resilient plastic material.

Figure 8:
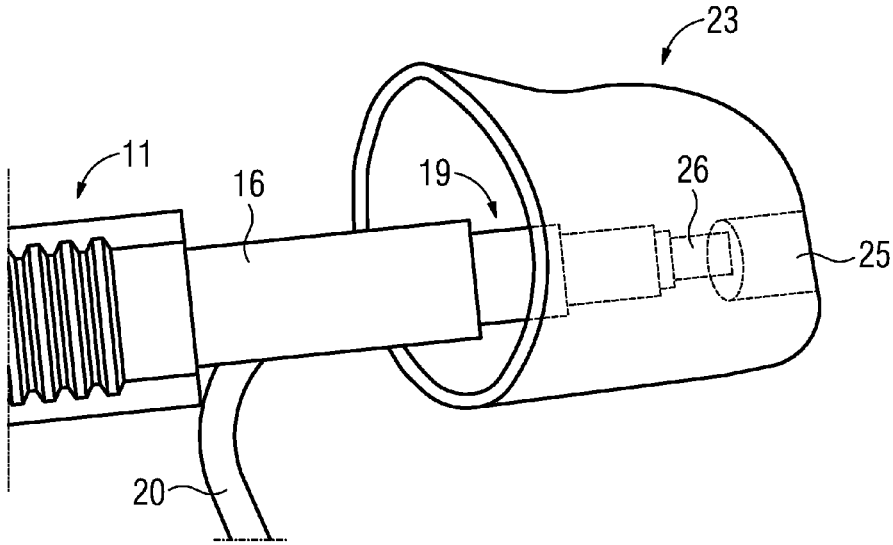
FIG. 8 is a diagrammatic, perspective view of the earpiece from FIG. 7 with the inserted receiver.

FIG. 8 shows the receiver 19 in the state when snapped into the ear mold 23. That is to say, the receiver 19 is plugged or snapped into the adapter 25. The tool (FIG. 8 also shows part of the second subsidiary body 11) can now be removed axially from the receiver 19.

To remove the receiver 19 from the ear mold 23, the short pin 13, i.e. the first tool part located at the other end face of the tool, can be used. For this purpose, the short pin 13 is pushed into the acoustic opening (not visible in FIG. 8) of the ear mold 23 until it meets the receiver 19. The pin 13 has approximately the same diameter as the acoustic output piece 26 of the receiver 19 (see FIG. 7). By pressing the short pin 13 in further, the receiver 19 is released from the adapter 25, such that it can be removed from the ear mold 23. If the ear mold 23 has a longer acoustic passage, the tool has to be turned around such that the long pin 14 (see FIG. 2) can be pushed all the way through the acoustic passage as far as the receiver 19 and beyond. Since the acoustic passage through the ear mold 23 in many cases does not extend in a straight line, the short pin 13 and the long pin 14 are both correspondingly flexible. However, they must be configured to be so stable that they can transfer the necessary axial force.

The tool according to the invention for fitting and removing a receiver of a hearing aid is distinguished by the fact it is in two parts, wherein three tool functions can be made available by simple inversion. The three tool functions, therefore, are made available by a single tool, which in itself forms one unit and is thus logistically easier to handle. The plugging together also has the advantage that a tool part can be less easily misplaced.

The long guide groove 21 and the socket 18 also ensure a secure hold of the receiver if tilting or twisting takes place during positioning. In addition, as has been mentioned, the long guide groove 21 offers protection against kinking and also protects the tube or cable 20 from damage. Moreover, the socket 18, which holds the receiver 19 axially, allows fitting to be carried out with rectilinear guiding, as a result of which less force has to be applied for fitting.

The invention claimed is:

1. A tool for fitting a receiver of a hearing aid into a first earpiece and into a structurally different, second earpiece and for removing the receiver from the first or second earpiece, the tool comprising:

an elongate main body divided into a first subsidiary body and a second subsidiary body and having a longitudinal axis;

a first tool part for removing the receiver from the first earpiece;

a second tool part for removing the receiver from the second earpiece; and a third tool part for fitting the receiver into the first or second earpiece; and said first and second two subsidiary bodies can be plugged at least partially one inside another in a direction of said longitudinal axis of said elongate main body, and two of said first, second and third tool parts are disposed on one of said first and second subsidiary bodies, and a remaining tool part is disposed on the other of said first and second subsidiary bodies.

2. The tool according to claim 1, wherein the tool is made of a flexible plastic.

3. The tool according to claim 1, wherein said first and second subsidiary bodies each have an elongate shape.

4. The tool according to claim 3, wherein said first subsidiary body has an end face with an opening formed therein into which said second subsidiary body can be plugged both with one of its end faces leading in a plugging direction, and also with its other end face leading in the plugging direction, into said opening of said first subsidiary body.

5. The tool according to claim 3, wherein said second subsidiary body has, on one end face thereof, said first tool part and, on the other end face thereof, said third tool part.

6. The tool according to claim 1, wherein said first and second tool parts are each configured as a pin formed integrally on one end face of one of said first and second subsidiary bodies.

7. The tool according to claim 6, wherein said two pins are of different lengths and are slimmer than both of said first and second subsidiary bodies.

8. The tool according to claim 3, wherein said third tool part has a shaft with a longitudinal axis extending coaxially with respect to said longitudinal axis of a respective said subsidiary body, and wherein said shaft is open on an end face of said subsidiary body and has a slit formed therein through which a cable of the receiver is guided out from said shaft.

9. The tool according to claim 8, wherein the receiver is plugged into said opening of said shaft and is held there by said shaft with frictional engagement.

10. The tool according to claim 9, wherein said shaft has, under said opening, a shoulder on which the receiver is supported.

* * * * *